United States Patent [19]

Link

[11] Patent Number: 4,557,470

[45] Date of Patent: Dec. 10, 1985

[54] GAS PRESSURE SPRING WITH A SAFETY DEVICE

[75] Inventor: Werner Link, Tieringen, Fed. Rep. of Germany

[73] Assignee: Wilhelm Link GmbH & Co. KG, Tieringen, Fed. Rep. of Germany

[21] Appl. No.: 551,822

[22] Filed: Nov. 10, 1983

[30] Foreign Application Priority Data

Jul. 22, 1983 [DE] Fed. Rep. of Germany ... 8321120[U]

[51] Int. Cl.[4] ..... B60G 11/26

[52] U.S. Cl. ..... 267/64.12; 138/110; 138/172; 188/322.11; 248/407; 267/131; 403/344

[58] Field of Search ..... 267/120, 131, 64.12, 267/64.18; 297/345; 248/161, 407, 408, 423; 403/344; 16/108; 48/192, 175; 138/172, 110, 159, 96 R; 188/322.11, 322.19; 72/368; 137/378, 377

[56] References Cited

U.S. PATENT DOCUMENTS

| | | | |
|---|---|---|---|
| 540,558 | 6/1895 | Peregrine | 403/344 X |
| 1,781,911 | 11/1930 | Ball | 248/423 X |
| 1,951,754 | 3/1934 | Gilbert | 248/407 X |
| 3,445,130 | 5/1969 | Obenshain | 403/344 |
| 3,707,032 | 12/1972 | Brunelle et al. | 138/110 X |
| 4,124,202 | 11/1978 | Hatakeyama | 267/131 X |
| 4,145,044 | 3/1979 | Wilson et al. | 248/407 X |
| 4,146,058 | 3/1979 | Bercovitz | 138/96 R |
| 4,217,061 | 8/1980 | Eiland et al. | 403/344 X |
| 4,257,582 | 3/1981 | Wirges | 297/345 X |
| 4,261,446 | 4/1981 | Bolger | 188/322.11 |

FOREIGN PATENT DOCUMENTS

| | | | |
|---|---|---|---|
| 0271599 | 11/1950 | Switzerland | 297/345 |

*Primary Examiner*—Bruce H. Stoner
*Assistant Examiner*—Robert J. Oberleitner
*Attorney, Agent, or Firm*—Michael J. Striker

[57] ABSTRACT

In a gas pressure spring for a chair, a locking device is provided, which includes a safety sleeve formed of two semi-circular halves which are clamped on an outer tube of the gas pressure spring by clamping bolts. The outer tube is formed with an end portion of a reduced diameter and a transition zone. The two halves of the safety sleeve are formed each with an inner collar matching the transition zone of the outer tube. One of the halves is formed with a through opening for passing a height-adjusting lever towards the outer tube.

9 Claims, 6 Drawing Figures

GAS PRESSURE SPRING WITH A SAFETY DEVICE

BACKGROUND OF THE INVENTION

The present invention relates to a gas pressure spring particularly utilized in a chair and provided with a safety device.

Gas pressure springs of the type under discussion include and outer tube which is drawn at one end thereof and at the other end of which a piston rod projects.

Gas pressure springs of this type have been utilized in office chairs as elastic or cushion elements and seat-adjusting elements. The outer tube of the spring in these constructions, which projects downwardly from a seat carrier is subject to high bending stresses or loads which can cause a break of the outer tube in exceptional cases and an accident due to blasting of the safety device on the outer tube of the spring, the blast could be caused by high gas pressure. A danger of blasting of the safety device on the outer tube may be avoided by providing on the upper end of the tube a drawn open portion.

SUMMARY OF THE INVENTION

It is an object of the present invention to provide an improved gas pressure spring for a chair.

It is a further object of the invention to provide the gas pressure spring with a safety device due to which a danger of breaking of the outer tube would be avoided.

It is a further object of the invention to provide a safety device for a gas pressure spring with which tearing up of the outer tube, cracking off of the drawn end portion of the tube of the gas pressure spring and a possible blasting caused by a high gas pressure exerted on the safety device would be avoided.

These and other objects of the invention are attained by a gas pressure spring for a chair, comprising an outer tubular element having an upper end drawn portion of a reduced diameter, a lower portion and a transition zone between said upper end portion and said lower portion, said tubular element being formed with a lateral opening for receiving therein an end of an adjusting lever operatively connected to the piston rod and operative for adjusting a vertical position of the chair; and safety means surrounding said upper end portion of the tubular element, said safety means including a ring-shaped safety sleeve formed of at least two releasably-connectable portions, which are clamped on the tubular element in the region of said lateral opening and said transition zone, each of the portions of the safety sleeve having an inner surface formed with a collar of a reduced diameter and matching said transition zone, at least one of said two portions being formed with a through hole for passing therethrough the end of the adjusting lever.

Preferably the safety sleeve may be formed of two similar semicircular halves of which one half is formed with said through opening; said two halves being separated from each other in a clamped position on said tubularr element at a separating plane, said through opening extending towards said tubular element perpendicularly to said separating plane.

Due to the provision in the locking means of the present invention of a safety collar of a reduced diameter matching that of the transition zone, this collar reliably and securely surrounds the transition zone of the tubular element in the critical and most breakable region of the tubular element, where the adjusting lever is inserted into the tubular element. Bending stresses or forces exerted on the tubular element are taken by that collar whereby the tubular element is relieved from these forces. Due to the circumferential collar formed by the two halves of the safety sleeve and matching the transition zone of the drawn open end of the tubular member a locking action is such that even if the drawn end portion is totally separated from the remaining portion of the tubular element this end portion will not be detached from that remaining portion. Blasting of the reduced end portion of the tube together with the locking ring would be avoided because two halves of the ring-shaped safety sleeve are clamped on the tubular element by clamping bolts.

An additional advantage of the safety means according to the invention is that the through opening for passing the adjusting lever toward the tubular member is formed not in the separation plane between two circular halves of the sleeve but in that part of the ring-shaped safety sleeve, which is circumferentially closed and is play-free.

The safety device may further include a pin inserted in one of said halves and extended in the direction towards said tubular element, said tubular member being formed with a notch matching said pin and receiving an end of said pin. This feature of the invention provides an additional form-locking connection which locks the ring-shaped sleeve on the tubular element against an axial displacement. The pin and the notch can substantially facilitate an assembling of the ring-shaped member on the tubular element.

Another advantage of the spring according to the invention resides in that the safety device can be applied to the gas pressure spring which has been previously installed on the office chair. To achieve this the safety means may include a hinge axle, and the halves of the safety sleeve may be hingedly connected to each other, so that two halves can not be lost.

The vertical movement of the chair seat carrier is not precluded by the ring-shaped sleeve. The ring-shaped sleeve may be preferably formed as a rotation element having a cylindrical portion which merges at the end of the sleeve into a conical portion which faces towards the seat carrier of the chair. The through opening may partially extend through said conical portion so that an enlarged free angle in the upward direction would be ensured for the adjusting lever.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DETAILED DESCRIPTION OF THE PREFERRED EMBODIMENTS

Figure 1:
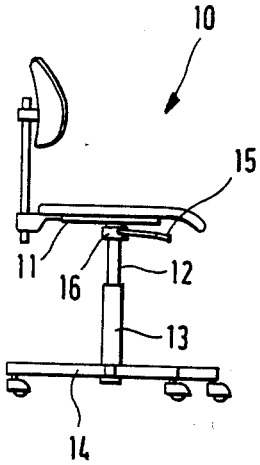
FIG. 1 is a side view of an office chair with a gas pressure spring according to the invention.

Referring now to the drawings in detail, and firstly to FIG. 1, an office chair generally designated as 10 includes a seat carrier 11 which is adjustably held on a gas pressure spring 12 so that the vertical postion of seat carrier 11 can be adjusted. A column or support 13 is connected at its lower end to a chair stand 14 formed in a usual manner by a number of outwardly extended rods positioned on the rollers. The lower end of gas pressure spring 12 extends into the column 13. A height-adjusting lever 15 laterally extended from the gas pressure spring 12 can open an overflow pressure valve positioned in the interior of the gas pressure spring and thereby change the position of the piston located inside the gas pressure spring and not illustrated therein and thus change the vertical position of the seat carrier 11.

The gas pressure spring 12 is provided with a safety device which is formed as a ring-shaped sleeve or collar 16 surrounding the upper end portion of the spring.

Figure 2:
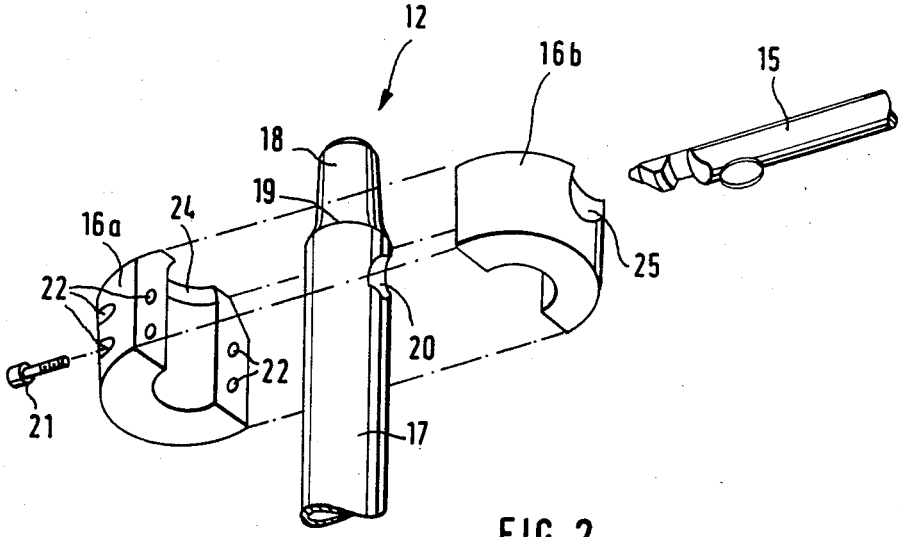
FIG. 2 is an exploded perspective view of the locking device of the gas pressure spring of the invention.
Figure 5:
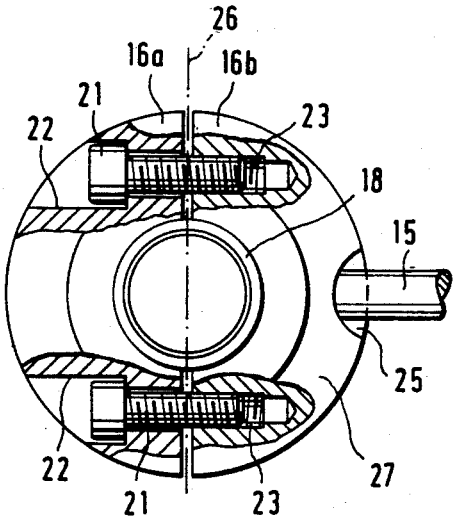
FIG. 5 is a top plan view, partially in section, of FIG. 3.
Figure 6:
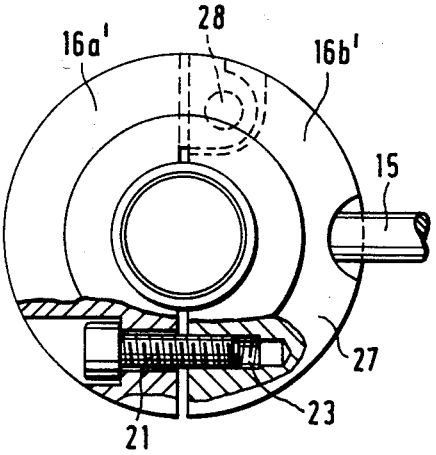
FIG. 6 is a top plan view, partially in section, of FIG. 4.

FIG. 2 illustrates an outer tube 17 of the gas pressure spring within which the above mentioned pistion is located. The outer tube 17 includes an end portion 18 which is drawn up from a transition zone 19 of the tube. A lateral insertion opening 20 for receiving the end of the adjusting lever 15 of the gas pressure spring 12 therein is formed in the tube 17. The ring-shaped body or safety collar 16 is formed of two semicircular halves **16*a* and 16*b*. Both halves can be connected to each other by means of countersunk bolts 21, which are inserted into respective holes 22 and then into threaded bores 23 aligned with holes 22, as can be seen in FIGS. 5 and 6. When halves 16*a* and 16*b* are bolted together they are clamped on the outer tube 17** of the gas pressure spring.

The inner circumference of the semicircular halves **16*a* and 16*b* at the upper regions thereof are provided with inwardly projected collars 24 which match the outer surface of the transition zone 19 of tube 17. A through bore 25 is formed in the semicircular half 16*b* which is made to be in alignment with the lateral insertion opening 20 of tube 17 so as to pass therethrough the end portion of adjusting lever 15 as shown in FIG. 3**.

Figure 3:
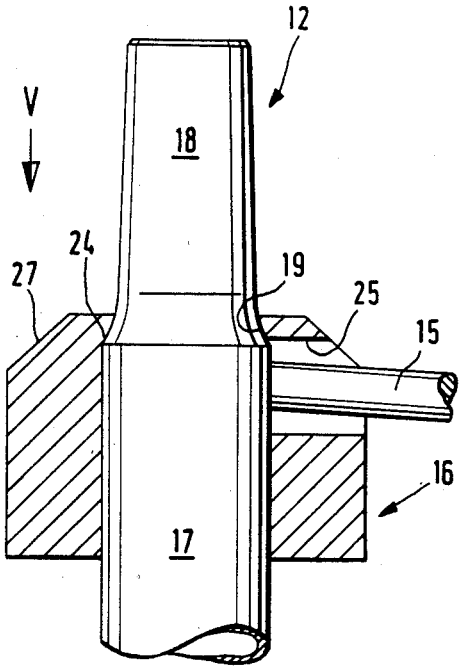
FIG. 3 is an axial sectional view through the locking device of the first embodiment of the invention.

FIGS. 3 and 5 show the ring-shaped safety collar 16 in the clamped position on the outer tube 17. The ring-shaped collar 16 is formed as a rotation element when two halves **16*a* and 16*b* are connected to each other. Two halves 16*a* and 16*b* are separated from each other at a separating plane 26 seen in FIG. 5 so that both halves do not contact each other although they are clamped together via bolts 21 on the clamping seat of outer tube 17. The upper portion of the substantially cylindrical safety sleeve 16 is formed with a conical outer surface 27 at which the above mentioned through opening 25** opens.

Figure 4:
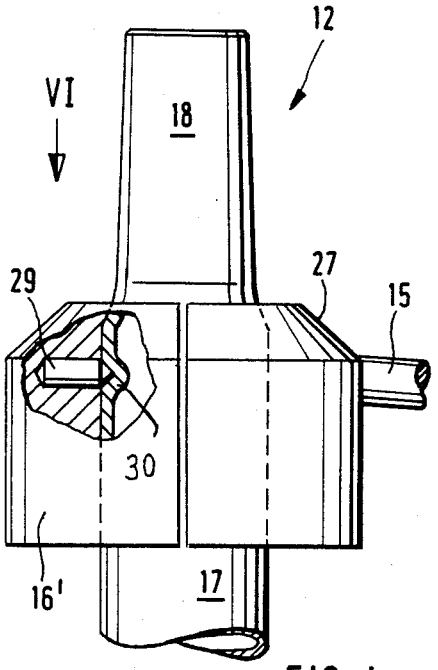
FIG. 4 is an axial sectional view through the locking device of another embodiment of the invention.

FIGS. 4 and 6 illustrate a modified embodiment of the safety collar 16' of the gas pressure spring according to the invention. The modified embodiment is distinguished from the structure shown in FIGS. 3 and 5, in that both semicircular halves **16*a*' and 16*b*' are hinged on a pin or hinge axle 28 which is parallel to the axis of the outer tube 17 whereby both halves are non-loseably connected to each other. The hinge connection of both safety halves is formed at one side of the safety collar in place of bolts 21 whereas at the other opposite side clamping bolts 21 are utilized to connect halves 16*a*' and 16*b*' to each other (only one bolt 21 is shown in FIG. 6 for the sake of clarity). Furthermore, the embodiment of FIG. 4 is provided with means preventing the safety collar or sleeve 16' from the axial displacement. For this purpose a bore transversal to the central axis of the safety collar is formed in the semi-circular half 16*a*', which bore receives a pin 29. The head of pin 29, facing the axis of the safety sleeve is plunged into a notch or groove 30 formed in the outer wall of outer tube 17. This notch in which the head of pin 29 should be received, can act as a guide while the safety sleeve 16' is clamped on the outer tube 17**.

It is, of course, understandable that only the components of the gas pressure spring related to the safety device according to the invention are disclosed in detail in the present application. The remaining components known in the art, such as piston-cylinder unit within the tube 17 and actuated by the adjusting lever 15 have not been discussed herein for the sake of simplicity.

It will be understood that each of the elements described above, or two or more together, may also find a useful application in other types of gas pressure springs differing from the types described above.

While the invention has been illustrated and described as embodied in a gas pressure spring for a chair, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A gas pressure spring for a chair, comprising an outer tubular element having a lower portion, an upper end drawn portion of a reduced diameter, and a transition zone between said upper end portion and said lower portion, said tubular element being formed with a lateral opening for receiving therein an end of an adjusting lever operative for adjusting a vertical position of the chair; and safety means surrounding said tubular element near said upper end portion thereof, said safety means including a ring-shaped safety sleeve formed of at least two releasably-connectable portions, which are clamped on the tubular element in the region of said lateral opening and said transition zone, each of the portions of the sleeve having an inner surface being formed with a collar inwardly extending from said inner surface and matching said transition zone and surrounding the same, at least one of said two portions being formed with a through hole for passing therethrough the end of the adjusting lever.

2. The gas pressure spring as defined in claim 1, wherein said sleeve is formed of two oppositely positioned semicircular halves of which one half is formed with said through opening, said two halves being spaced from each other in clamped position on said tubular element at a separating plane, said through opening extending towards said tubular element perpendicularly to said separating plane.

3. The gas pressure spring a defined in claim 2, said safety means further including means for connecting said halves to each other in said clamped position.

4. The gas pressure spring as defined in claim 3, wherein said ring-shaped sleeve is formed as a cylindrical portion which merges at an end of the sleeve into a conical portion.

5. The gas pressure spring as defined in claim 4, wherein said through opening partially extends through said conical portion.

6. The gas pressure spring as defined in claim 3, wherein said connecting means include countersunk bolts.

7. The gas pressure spring as defined in claim 3, wherein said connecting means include a hinge axle, said halves being hingedly connected to each other at said separating plane.

8. The gas pressure spring as defined in claim 7, wherein said connecting means further include countersunk bolts clamping said halves hinged towards each other on said tubular element.

9. The gas pressure spring as defined in claim 8, further including a pin inserted in one of said halves and extended in the direction towards said tubular element, said tubular member being formed with a notch matching said pin and receiving an end of said pin.

* * * * *